US006713439B2

(12) United States Patent
Watts

(10) Patent No.: US 6,713,439 B2
(45) Date of Patent: Mar. 30, 2004

(54) ENERGY CONSERVING POWER TRANSMISSION FLUIDS

(75) Inventor: Raymond F. Watts, Long Valley, NJ (US)

(73) Assignee: Infineum International Ltd. (GB)

( * ) Notice: Subject to any disclaimer, the term of this patent is extended or adjusted under 35 U.S.C. 154(b) by 0 days.

(21) Appl. No.: 10/162,840

(22) Filed: Jun. 5, 2002

(65) Prior Publication Data

US 2003/0228987 A1 Dec. 11, 2003

(51) Int. Cl.[7] ..... C10M 111/04
(52) U.S. Cl. ..... 508/485; 508/591; 252/73
(58) Field of Search ..... 508/485

(56) References Cited

U.S. PATENT DOCUMENTS 4,175,047 A * 11/1979 Schick et al. ..... 508/485
4,589,990 A * 5/1986 Zehler et al. ..... 508/485
4,956,122 A * 9/1990 Watts et al. ..... 508/485
5,151,205 A * 9/1992 Culpon, Jr. ..... 508/485
5,554,311 A * 9/1996 Katafuchi et al. ..... 508/485
6,110,877 A * 8/2000 Roberts ..... 508/485

* cited by examiner

*Primary Examiner*—Ellen M McAvoy

(57) ABSTRACT

An energy conserving power transmission fluid composition comprising:

(a) from 1 to 49 wt. % of a polyalphaolefin base stock having a kinematic viscosity of from 40 $mm^2/s$ at 100° C. to 500 $mm^2/s$ at 100° C.;

(b) from 1 to 95 wt. % of a lubricant basestock having a kinematic viscosity of from 2 $mm^2/s$ at 100° C. to 10 $mm^2/s$ at 100° C.;

(c) from 1 to 49 wt. % of a polyol ester of a $C_5$ to $C_{30}$ aliphatic monocarboxylic acid and a polyol of the formula $R(OH)_n$ where n is at least 2, and (d) an effective amount of a performance additive package selected from the group consisting of automotive gear oil additive packages, manual transmission fluid additive packages and automatic transmission fluid additive packages, provided that the composition has a kinematic viscosity of at least 4 $mm^2/s$ at 100° C.

8 Claims, No Drawings

ENERGY CONSERVING POWER TRANSMISSION FLUIDS

BACKGROUND OF THE INVENTION

This invention relates to a power transmission fluid composition capable of reducing the energy consumption of transmissions, differentials, or other devices in which it is used.

Over the last decade manufacturers of gear systems, especially automobile builders, have sought methods to reduce the energy consumption of these devices and the automobiles in which they are used. Improvements in automobile transmissions such as continuously variable transmissions and 6 speed automatic transmissions have made large strides in reducing energy consumption of cars. In some cases, such as manual transmissions, differentials used in axles and in fixed speed reduction gearing little improvement in the hardware can be made to gain further energy conservation. In these cases manufacturers seek improvements in the lubricant to provide the energy savings. The challenge is to reduce energy dissipated in the gear contact. This energy is lost as heat. Therefore, lowering the energy lost in the gear contact will lower the bulk fluid temperature. If the lubricant is capable of doing this, either through judicious choice of lubricant base stocks, or additives, then it can truly be called an energy conserving power transmission fluid.

It is well known that lowering the viscosity of a lubricant can lower the energy consumed in the device in which it is used. This technique is especially important at lower operating temperatures where lubricant viscosities are elevated. The technique works as long as adequate hydrodynamic films are provided in the device. If viscosity is lowered too far, hydrodynamic films fail and friction increases, thereby increasing energy consumption. Reduction of energy consumption through reducing fluid viscosity is often referred to as reducing "churning losses". However, we have now found that by appropriate selection of lubricant basestocks energy consumption in gear contact can be reduced, independent of viscosity, thereby permitting the formulation of energy conserving lubricants of higher viscosity.

For the purposes of this invention a power transmission fluid is defined as any lubricant used in contact with gears involved in the transmission of mechanical energy. Commonly these devices would include, but not be limited to, automatic transmissions, manual transmissions, continuously variable transmissions, automated manual transmissions, transfer cases, axles and differentials used in mobile applications. They would also include stationary gearing used in industrial applications as well as industrial transmissions.

We have found that power transmission fluids comprised of base fluids made up of high viscosity polyalphaolefins, certain polyol esters and other lubricant basestocks, containing appropriate performance additive packages for the required applications, can yield significant energy savings when compared to the same composition without the polyol ester.

SUMMARY OF THE INVENTION

This invention relates to an energy conserving power transmission fluid composition comprising:

(a) from 1 to 49 wt. % of a polyalphaolefin base stock having a kinematic viscosity of from 40 $mm^2/s$ at 100° C. to 500 $mm^2/s$ at 100° C.;

(b) from 1 to 95 wt. % of a lubricant basestock having a kinematic viscosity of from 2 $mm^2/s$ at 100° C. to 10 $mm^2/s$ at 100° C.;

(c) from 1 to 49 wt. % of a polyol ester of a $C_5$ to $C_{30}$ monocarboxylic acid and a polyol of the formula $R(OH)_n$ where n is at least 2, up to 5, and R is any aliphatic or cycloaliphatic hydrocarbyl group; and (d) an effective amount of a performance additive package provided that the composition has a kinematic viscosity of at least 4 $mm^2/s$ at 100° C.

The stabilization temperature of the compositions of this invention with the polyol ester is at least 2° C. lower than the same composition tested without the polyol ester, when tested by an appropriate method.

DETAILED DESCRIPTION OF THE INVENTION

Polyalphaolefin

Polyalphaolefins (PAO) are oligomers of terminally unsaturated alkenes. The polyalphaolefins of the present invention are characterized by their viscosities. For purposes of this invention, the high viscosity polyalphaolefins are defined as possessing kinematic viscosities at 100° C. of from about 40 to about 500 $mm^2/s$. Production of high viscosity polyalphaolefins is well known in the art and is described for example in U.S. Pat. No. 4,041,098.

Polyalphaolefins can be made from any terminally unsaturated olefin or mixtures of terminally unsaturated olefins. The preferred polyalphaolefins are made from 1-octene or 1-decene or mixtures thereof. They can be saturated or unsaturated. The preferred PAO's have kinematic viscosities from about 40 to about 250 $mm^2/s$, and the most preferred from about 40 to 100 $mm^2/s$. The most preferred PAO's are also saturated by hydrogenation.

The compositions of this invention will contain a minor amount of the high viscosity polyalphaolefin. Typically, amounts will range from 1 to 49% by weight. The exact amount will be determined by the desired kinematic viscosity of the final lubricant.

Lubricant Basestock

Lubricating oils contemplated for use in this invention are either natural lubricating oils, synthetic lubricating oils or derived from mixtures of natural lubricating oils and synthetic lubricating oils. Suitable lubricating oils also include basestocks obtained by isomerization of synthetic wax and slack wax, as well as basestocks produced by hydrocracking (rather than by solvent treatment) the aromatic and polar components of the crude. The lubricating oil will have a kinematic viscosity ranging from about 2 to about 10 $mm^2/s$ (cSt) at 100° C. Natural lubricating oils include animal oils, vegetable oils (e.g., castor oil and lard oil), petroleum oils, mineral oils, and oils derived from coal or shale. The preferred natural lubricating oil is mineral oil.

The mineral oils useful in this invention include all common mineral oil basestocks. This would include oils that are naphthenic or paraffinic in chemical structure as well as oils that are refined by conventional methodology using acid, alkali, and clay or other agents such as aluminum chloride, or they may be extracted oils produced, e.g., by solvent extraction or treatment with solvents such as phenol, sulfur dioxide, furfural, dichlorodiethyl ether, etc. They may be hydrotreated or hydrofined, dewaxed by chilling or catalytic dewaxing processes, or hydrocracked. The mineral oil may be produced from natural crude sources or be composed of isomerized wax materials or residues of other refining processes.

A particularly useful class of mineral oils are those mineral oils that are severely hydrotreated or hydrocracked.

These processes expose the mineral oils to very high hydrogen pressures at elevated temperatures in the presence of hydrogenation catalysts. Typical processing conditions include hydrogen pressures of approximately 3000 pounds per square inch (psi) at temperatures ranging from 300° C. to 450° C. over a hydrogenation-type catalyst. This processing removes sulfur and nitrogen from the lubricating oil and saturates any alkylene or aromatic structures in the feedstock. The result is a base oil with extremely good oxidation resistance and viscosity index. A secondary benefit of these processes is that low molecular weight constituents of the feed stock, such as waxes, can be isomerized from linear to branched structures thereby providing finished base oils with significantly improved low temperature properties. These hydrotreated base oils may then be further de-waxed either catalytically or by conventional means to give them exceptional low temperature fluidity. Commercial examples of lubricating base oils made by one or more of the aforementioned processes are Chevron RLOP, Petro-Canada P65, Petro-Canada P100, Yukong, Ltd., Yubase 4, Imperial Oil Canada MXT, Fortum Nexbase 3060, and Shell XHVI 5.2.

Synthetic lubricating oils include hydrocarbon oils and halo-substituted hydrocarbon oils such as oligomerized, polymerized, and interpolymerized olefins [e.g., polybutylenes, polypropylenes, propylene, isobutylene copolymers, chlorinated polylactenes, poly(1-hexenes), poly (1-octenes), poly(1-decenes), etc., and mixtures thereof]; alkylbenzenes [e.g., dodecylbenzenes, tetradecylbenzenes, dinonylbenzenes, di(2-ethylhexyl)benzene, etc.]; polyphenyls [e.g., biphenyls, terphenyls, alkylated polyphenyls, etc.]; and alkylated diphenyl ethers, alkylated diphenyl sulfides, as well as their derivatives, analogs, and homologs thereof, and the like. The preferred oils from this class of synthetic oils are oligomers of α-olefins, particularly oligomers of 1-decene and other polyalphaolefins.

The lubricant base stock will have kinematic viscosities of from 2.0 $mm^2/s$ (cSt) to 10.0 $mm^2/s$ (cSt) at 100° C. The preferred mineral oils have kinematic viscosities of from 2 to 6 $mm^2/s$ (cSt), and most preferred are those mineral oils with viscosities of 3 to 5 $mm^2/s$ (cSt), at 100° C.

The lubricant base stock will be present in the composition of this invention in amounts ranging from about 1 to 95 wt. %, preferably 5 to 75 wt. %.

Polyol Ester

The polyol esters of the current invention are those prepared from polyhydroxy species, such as trimethylol propane, neopentyl glycol, pentaerythritol, and long chain carboxylic acids. Esters useful in this invention include those made from $C_5$ to $C_{30}$ monocarboxylic acids and polyols and polyol ethers such as neopentyl glycol, trimethylolpropane pentaerythritol, dipentaerythritol, tripentaerythritol, and the like.

Suitable polyols have the formula $R(OH)_n$ wherein R is any aliphatic or cycloaliphatic hydrocarbyl group (preferably an alkyl) and n is at least 2, up to about 5, preferably 3–5. The hydrocarbyl group may contain from about 2 to about 20 or more carbon atoms, and the hydrocarbyl group may also contain substituents such as chlorine, nitrogen and/or oxygen atoms. The polyhydroxyl compounds generally may contain one or more oxyalkylene groups and, thus, the polyhydroxyl compounds include compounds such as polyetherpolyols. The number of carbon atoms (i.e., carbon number, wherein the term carbon number as used throughout this application refers to the total number of carbon atoms in either the acid or alcohol as the case may be) and number of hydroxy groups (i.e., hydroxyl number) contained in the polyhydroxyl compound used to form the carboxylic esters may vary over a wide range.

The following alcohols are particularly useful as polyols: neopentyl glycol, trimethylolethane, trimethylolpropane, trimethylolbutane, mono-pentaerythritol, technical grade pentaerythritol, and di-pentaerythritol. The most preferred alcohols are technical grade (e.g., approximately 88% mono-, 10% di- and 1–2% tri-pentaerythritol) pentaerythritol, monopentaerythritol, dipentaerythritol and trimethylolpropane.

Suitable aliphatic monocarboxylic acids for preparing the polyol ester used in the present invention include both saturated and unsaturated acids having about 5 to 30 carbon atoms such as stearic acid, isostearic acid, oleic acid, linoleic acid, lauric acid, tall oil fatty acid, hexanoic acid, heptanoic acid, decanoic acid, capric acid, valeric acid and the like.

A preferred polyol ester is trimethylolpropane isostearate sold as "Priolube 3999" having a kinematic viscosity of 13.19 $mm^2/s$ at 100° C. and 91.66 $mm^2/s$ at 40° C.

The polyol ester will be present in an amount of 1 to 49 wt. %, preferably 5 to 50 wt. %, more preferably 5 to 25 wt. %.

Performance Additive Package

The performance additive package will be determined by the desired end use application. In general power transmission fluid performance packages contain anti-oxidants, anti-wear agents, friction modifiers, ashless dispersants, extreme pressure agents, corrosion inhibitors, viscosity modifiers and anti-foamants, each present in customary amounts so as to provide their normal attendant functions, such as 1 to 25 wt. %. The exact amounts and presence or absence of the individual components will be determined by the intended application. Preferred are compositions free of polymeric viscosity modifier.

Automotive Gear Oil—one type of automotive gear oil additive package would contain one or more of a highly sulfurized hydrocarbon or ester, a phosphite or phosphate, corrosion inhibitors, dispersants and anti-foamants. Examples of commercially available gear oil additive packages are: Anglamol 99, Anglamol 6043, Anglamol 6085 from the Lubrizol Corporation; Hitec 320, Hitec 323, Hitec 350 and Hitec 385 from the Ethyl Corporation; Mobilad G-252, Mobilad G-251 and Mobilad G-2001 available from ExxonMobil Chemical Company.

A second type of automotive gear oil additive package consists of colloidally dispersed potassium triborate particles. This technology is described in U.S. Pat. Nos. 3,853,772; 3,912,639; 3,912,643 and 4,089,790. An examples of a commercially available gear oil package based on this technology is OLOA 9151X from Oronite division of ChevronTexaco Chemical Company.

Automotive gear oil additive packages are normally present from about 1% to about 15% by weight of the finished lubricant.

Manual Transmission Fluid—manual transmission fluids can be directly formulated from specialized additive packages or from reduced treat rates of automotive gear oil packages. Manual transmission fluid additive packages generally contain one or more anti-wear agents, ashless dispersants, corrosion inhibitors, friction modifiers, anti-foamants and sometimes viscosity modifiers. An example of a commercially available manual transmission fluid additive package is Infineum T4804 from Infineum, which contain antifoamant, antioxidant, rust inhibitor, magnesium sulfonate detergent, seal swellant, amine phosphate antiwear additive, borated polyisobutenyl succinimide dispersant and friction modifier, each present in customary amounts so as to provide their normal attendant function.

Manual transmission fluid additives generally comprise from about 1% to about 10% of the weight of the finished lubricant.

Automatic Transmission Fluid—automatic transmission fluid additive packages normally consist of ashless dispersants; anti-wear agents; anti-oxidants; corrosion inhibitors; friction modifiers; seal swell agents; anti-foamants and sometimes viscosity modifiers. Examples of commercially available automatic transmission fluid additives are: Lubrizol 6950; Lubrizol 7900; Lubrizol 9614 from the Lubrizol Corporation; Hitec 403; Hitec 420; Hitec 427 from the Ethyl Corporation and Infineum T4520, Infineum T4540 from Infineum.

Automatic transmission fluid additives normally comprise from about 1 to about 20% of the weight of the finished lubricant.

Representative amounts of additives in an automatic transmission fluid are summarized as follows:

| Additive | Broad Wt. % | Preferred Wt. % |
|---|---|---|
| VI Improvers | 1–12 | 1–4 |
| Corrosion Inhibitor | 0.01–3 | 0.02–1 |
| Dispersants | 0.10–10 | 2–5 |
| Antifoaming Agents | 0.001–5 | 0.001–0.5 |
| Detergents | 0.01–6 | 0.01–3 |
| Antiwear Agents | 0.001–5 | 0.2–3 |
| Pour Point Depressants | 0.01–2 | 0.01–1.5 |
| Seal Swellants | 0.1–8 | 0.5–5 |
| Friction Modifiers | 0.01–10 | 0.1–5 |
| Antioxidants | 0.01–10 | 0.1–5 |

There are several methods that have utility in determining the relative energy conserving ability of lubricants in power transmission applications. Although neither method is universally accepted, both have been shown to correlate with field applications. The premise of both methods is reduction of heat generation in highly loaded mechanical contact. The assumption being made is that the lower the steady state operating temperature of the device, the less energy is being converted to heat. Consequently the more energy available to be transmitted.

ARKL (axial thrust ball bearing) test. This test has been developed by Volkswagen and the procedure is available as PV 1454 from Volkswagen AG. In this test a highly loaded (5,000 N) ball type thrust bearing is run (@4,000 rpm) in the test lubricant (40 ml) for 120 minutes. The test bearing and lubricant are contained in an insulated housing fitted with thermocouples. At the end of the 120 minute running time the steady state temperature is determined by using the following equation:

$$T_{steadystate}=(30^\circ\ \text{C.}-T_{ambient})+T_{test\ oil}$$

FZG Steady State Temperature—This procedure uses an FZG Gear Test apparatus as described in ASTM procedure D-5182. To perform the steady state temperature stabilization test the apparatus is equipped with a thermocouple to monitor the bulk oil temperature, fitted with "C" profile gears and filled with 1250 ml's of test lubricant. After a short break-in (15 minutes) at load stage 4 the machine is loaded to load stage 8 and run for 6 hours at 1450 rpm. The lubricant temperature is monitored during the running period and the stabilized temperature at the end of test is reported. This value is most often compared to that of a reference lubricant.

The following examples are given as specific illustrations of the claimed invention. It should be understood, however, that the invention is not limited to the specific details set forth in the examples. All parts and percentages are by weight unless otherwise specified.

EXAMPLES

For the purposes of exemplifying the benefits of this invention, two automotive gear oils were prepared. Fluid 1 contains a polyol ester representative of the claimed invention and Fluid 2 which contains a common di-ester of azeleic acid not of the invention. In all other respects the fluids are identical. The compositions of the two fluids, as well as their kinematic viscosities, are shown in Table 1 below. The ratio of PAO-100 (a hydrogenated polydecene-1) to PAO-6 (a hydrogenated polydecene-1) has been varied to keep the kinematic viscosities of the two fluids very similar.

TABLE 1

Test Fluid Compositions*

| Component | Fluid 1 | Fluid 2 |
|---|---|---|
| Mobilad G-2001[1] | 10.0 | 10.0 |
| PAO-100[2] | 32.3 | 38.7 |
| PAO-6[3] | 47.7 | 41.3 |
| Trimethylol propane isostearate[4] | 10.0 | — |
| Di-(2-ethylhexy) azelate[5] | — | 10.0 |
| Fluid Viscosity | | |
| Kinematic Viscosity at 100° C., $mm^2/s$ | 16.8 | 17.1 |

*Given in mass percent

[1]Available from ExxonMobil Chemical Co., Houston, TX, a gear oil additive package.

[2]Available as Synton 100 from Crompton Corp., Middlebury, CT, kv = 100 $mm^2/s$ at 100° C.

[3]Available as SHF 63 from ExxonMobil Chemical Co., Houston, TX, kv = 6 $mm^2/s$ at 100° C.

[4]Available as Priolube 3999 from Uniquema, Gouda, Netherlands.

[5]Available as Emery 2958 from Cognis Corp., Cincinnatti, OH.

The two test lubricants were both evaluated for thermal stabilization using the FZG procedure previously described. The results of that testing are shown in Table 2 below.

TABLE 2

Thermal Stabilization Temperature

| | Fluid 1 | Fluid 2 |
|---|---|---|
| Stabilization Temperature, ° C. | 95 | 112 |

This example clearly shows the benefit achieved by using the esters of the current invention as compared to other types of esters.

What is claimed:

1. An energy conserving power transmission fluid composition comprising:

(a) from 1 to 49 wt. % of a polyalphaolefin base stock having a kinematic viscosity of from 40 $mm^2/s$ at 100° C. to 500 $mm^2/s$ at 100° C.;

(b) from 1 to 95 wt. % of a lubricant basestock having a kinematic viscosity of from 2 $mm^2/s$ at 100° C. to 10 $mm^2/s$ at 100° C.;

(c) from 1 to 49 wt. % of a polyol ester of a $C_5$ to $C_{30}$ aliphatic monocarboxylic acid and a polyol of the formula $R(OH)_n$ where n is at least 2, and (d) an effective amount of a performance additive package selected from the group consisting of automotive gear oil additive packages, manual transmission fluid additive packages and automatic transmission fluid additive packages, provided that the composition has a kinematic viscosity of at least 4 $mm^2/s$ at 100° C.

2. The composition of claim 1 free of polymeric viscosity modifier.

3. The composition of claim 1 wherein the lubricant basestock is a polyalphaolefin.

4. The composition of claim 1 wherein the lubricant basestock is a mineral oil.

5. The composition of claim 1 wherein the additive package is a manual transmission fluid additive package.

6. The composition of claim 1 wherein the additive package is a gear oil additive package.

7. The composition of claim 1 wherein the polyol ester is trimethylolpropane isostearate.

8. The composition of claim 4 wherein the mineral oil has a kinematic viscosity of 2 to 6 $mm^2/s$ at 100° C.

* * * * *